US008672693B2

(12) United States Patent
Liu

(10) Patent No.: US 8,672,693 B2
(45) Date of Patent: Mar. 18, 2014

(54) USB INTERFACE AND DATA PRODUCT WITH THE INTERFACE

(75) Inventor: Ning Liu, Shenzhen (CN)

(73) Assignee: ZTE Corporation, Shenzhen , Guangdong Province (CN)

( * ) Notice: Subject to any disclaimer, the term of this patent is extended or adjusted under 35 U.S.C. 154(b) by 0 days.

(21) Appl. No.: 13/395,231

(22) PCT Filed: Mar. 14, 2011

(86) PCT No.: PCT/CN2011/071771

§ 371 (c)(1),
(2), (4) Date: Mar. 9, 2012

(87) PCT Pub. No.: WO2012/092726

PCT Pub. Date: Jul. 12, 2012

(65) Prior Publication Data

US 2013/0273759 A1 Oct. 17, 2013

(30) Foreign Application Priority Data

Jan. 7, 2011 (CN) ..... 2011 1 0003256

(51) Int. Cl.
*H01R 13/44* (2006.01)

(52) U.S. Cl.
USPC ..... 439/131; 439/8

(58) Field of Classification Search
USPC ..... 439/8, 11, 13, 21, 31, 131, 936
See application file for complete search history.

(56) References Cited

U.S. PATENT DOCUMENTS 6,786,743 B2 * 9/2004 Huang ..... 439/131
6,893,267 B1 * 5/2005 Yueh ..... 439/8
7,066,753 B1 * 6/2006 Tseng ..... 439/259
7,113,812 B2 * 9/2006 Li ..... 455/575.1
7,121,852 B2 * 10/2006 Ng et al. ..... 439/131
7,179,099 B2 * 2/2007 Hsieh ..... 439/131
7,510,420 B2 * 3/2009 Mori ..... 439/446
7,574,273 B2 * 8/2009 Obata et al. ..... 700/94
7,824,186 B2 * 11/2010 Zhao et al. ..... 439/13
8,125,774 B2 * 2/2012 Kelley et al. ..... 361/679.31

FOREIGN PATENT DOCUMENTS

CN 2738529 Y 11/2005
CN 201134604 Y 10/2008
CN 201327940 Y 10/2009

OTHER PUBLICATIONS

International Search Report for PCT/CN2011/071771 dated Sep. 16, 2011.

* cited by examiner

*Primary Examiner* — Thanh Tam Le
(74) *Attorney, Agent, or Firm* — Ling Wu; Stephen Yang; Ling and Yang Intellectual Property

(57) ABSTRACT

The present invention discloses a USB interface comprising a turnover joint (21), a rotating joint (22) and a connecting shaft (24) connecting the turnover joint (21) with the rotating joint (22); wherein one end of the turnover joint (21) is connected to a data product body (1), and the other end is connected to the rotating joint (22); and the end of the rotating joint (22) that is away from the turnover joint (21) is provided with a connecting terminal (25), which is connected to the data product body (1) via a cable (27); the rotating joint (22) is rotatable relative to the turnover joint (21). The present invention further discloses a data product with the USB interface. Using the present invention, when the data product is plugged into an electronic product, a variety of different position relationships may be generated with respect to the electronic product.

12 Claims, 6 Drawing Sheets

USB INTERFACE AND DATA PRODUCT WITH THE INTERFACE

TECHNICAL FIELD

The present invention relates to the field of data transmission and communication technology, and more particularly, to a USB interface and a data product with the interface.

BACKGROUND OF THE RELATED ART

At present, there are more and more data products which use Universal Serial Bus (USB) interfaces. Such standard interfaces facilitate data transmission between various data products and have been developed in various different structural forms. For example, direct insert type interfaces are relatively common in USB flash disks (U-disk for short); lead wire type interfaces have become standard configuration in many data products; and turnover type interfaces are mostly used in network cards. With the development of electronic products, however, a plurality of data products may be plugged into one electronic product, thus interfaces of the data product are required to have flexible plug structures so as to avoid interference between them. However, if flexible plug structures are used, the stability and reliability of communication will be affected, or even failure will occur, resulting in damage to the interfaces.

CONTENT OF THE INVENTION

A technique problem to be solved by the present invention is provide a USB interface whose structure is simple and whose position is flexible and variable, and in which communication is stable and reliable, and a data product using the interface.

In order to solve the above problem, the present invention provides a universal serial bus (USB) interface comprising a turnover joint (21), a rotating joint (22) and a connecting shaft (24) connecting the turnover joint (21) with the rotating joint (22).

One end of the turnover joint (21) is connected to a data product body (1), and the other end is connected to the rotating joint (22).

The end of the rotating joint (22) that is away from the turnover joint (21) is provided with a connecting terminal (25), which is connected to the data product body (1) via a cable (27); the rotating joint (22) is rotatable relative to the turnover joint (21).

The turnover joint (21) is connected to the data product body (1) via a turnover shaft (23), which is fixedly connected to the rotating joint (22) and rotatably connected to the turnover joint (21).

A ground structure (26) is provided on the connecting terminal (25).

The cable (27) is connected to the turnover joint (21) through the connecting shaft (24) and is provided with a securing structure (28), used for securing the cable (27), on a position close to the connecting terminal (25).

A turnover-in-place structure (3) is positioned in the turnover joint (21) and comprises:

turnover grooves (31) provided on a surface of the turnover shaft (23);

a turnover-in-place ball (32), the shape of which matches those of the turnover grooves (31), provided in a turnover-in-place pore canal (34) connected to the turnover shaft (23), both ends of the turnover-in-place ball (32) abutting against the turnover-in-place grooves (31) and a turnover-in-place spring (33);

the turnover-in-place spring (33) positioned in the turnover-in-place pore canal (34), one end of the turnover-in-place spring (33) being fixed, and the other end pushing the turnover-in-place ball (32) through a connector.

A rotating-in-place structure (4) is positioned between the connecting shaft (24) and the turnover joint (21) and comprises:

rotating grooves (41) provided on a surface of the rotating shaft (24);

a rotating-in-place ball (42), the shape of which matches those of the rotating grooves (41), provided in a rotating-in-place pore canal (44) connected to the connecting shaft (24), both ends of the rotating-in-place ball (42) abutting against the rotating-in-place grooves (41) and a rotating-in-place spring (43); and the rotating-in-place spring (43) positioned in the rotating-in-place pore canal (44), one end of the turnover-in-place spring (43) being fixed, and the other end pushing the turnover-in-place ball (32) through a connector.

A position limiting structure (29) for limiting a rotation angle of the rotating joint (22) relative to the turnover joint (21) is positioned between the connecting shaft (24) and the turnover joint (21).

In order to solve the above problem, the present invention also provides a data product with a universal serial bus (USB) interface comprising a data product body (1) and a USB interface (2).

The USB interface (2) comprises a turnover joint (21), a rotating joint (22), a connecting shaft (24) connecting the turnover joint (21) with the rotating joint (22), and a turnover shaft (23) connecting the data product body (1) with the turnover joint (21).

A trough (11) matching the USB interface (2) is provided in a corresponding position in the data product body (1).

The end of the rotating joint (22) that is away from the turnover joint (21) is provided with a connecting terminal (25), which is connected to the data product body (1) via a cable (27).

The rotating joint (22) is rotatable relative to the turnover joint (21), which is rotatable relative to the data product body (1).

The connecting shaft (24) is fixedly connected to the rotating joint (22) and rotatably connected to the turnover joint (21).

A ground structure (26) is provided on the connecting terminal (25).

The cable (27) is connected to the turnover joint (21) through the connecting shaft (24) and is provided with a securing structure (28), used for securing the cable (27), on a position close to the connecting terminal (25).

A turnover-in-place structure (3) is positioned in the turnover joint (21) and comprises:

turnover grooves (31) provided on a surface of the turnover shaft (23);

a turnover-in-place ball (32), the shape of which matches those of the turnover grooves (31), provided in a turnover-in-place pore canal (34) connected to the turnover shaft (23), both ends of the turnover-in-place ball (32) abutting against the turnover-in-place grooves (31) and a turnover-in-place spring (33); and the turnover-in-place spring (33) positioned in the turnover-in-place pore canal (34), one end of the turnover-in-place spring (33) being fixed, and the other end pushing the turnover-in-place ball (32) through a connector.

A rotating-in-place structure (4) is positioned between the connecting shaft (24) and the turnover joint (21) and comprises:

rotating grooves (41) provided on a surface of the rotating shaft (24);

a rotating-in-place ball (42), the shape of which matches those of the rotating grooves (41), provided in a rotating-in-place pore canal (44) connected to the connecting shaft (24), both ends of the rotating-in-place ball (42) abutting against the rotating-in-place grooves (41) and a rotating-in-place spring (43); and the rotating-in-place spring (43) positioned in the rotating-in-place pore canal (44), one end of the rotating-in-place spring (43) being fixed, and the other end pushing the rotating-in-place ball (42) through a connector.

A position limiting structure (29) for limiting a rotation angle of the rotating joint (22) relative to the turnover joint (21) is positioned between the connecting shaft (24) and the turnover joint (21).

The cable (27) comprises four coaxial cables coated with a shielding material.

The present invention has the following advantages.

1. In the present invention, a turnover joint and a rotating joint are used such that when a data product is plugged into an electronic product, a variety of different position relationships may be generated with respect to the electronic product. The position relationships are very flexible and may be selected according to different practical requirements.

2. In the present invention, a ground structure is provided on a connecting terminal and is fixed, and a movable connection between a connecting shaft and the turnover joint may be used to effectively improve the reliability and stability of communication.

3. In the present invention, in-place structures are used within the turnover joint as well as between the connecting shaft and the turnover joint so as to facilitate rotating-in-place and turnover-in-place in the data product in accordance with the present invention, extend the usage function, and increase the stability of in-place in use.

4. In the present invention, a position limiting structure is positioned between the connecting shaft and the turnover joint so as to effectively limit a rotating angle of the rotating joint relative to the turnover joint, and avoid winding and breaking of a communication cable due to over-rotation of the rotating joint, causing unnecessary losses.

PREFERRED EMBODIMENTS OF THE PRESENT INVENTION

Embodiments of the present invention will be described in detail in the following with combination with the accompanying figures. It should be noted that the embodiments of the present application and features in the embodiments may be combined arbitrarily without confliction.

Figure 1:
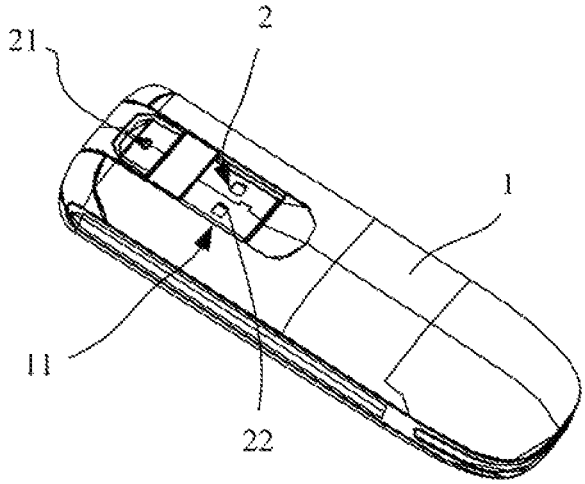
FIG. 1 illustrates a structural diagram of a data product with a USB interface in a retraction state in accordance with an embodiment of the present invention.
Figure 2:
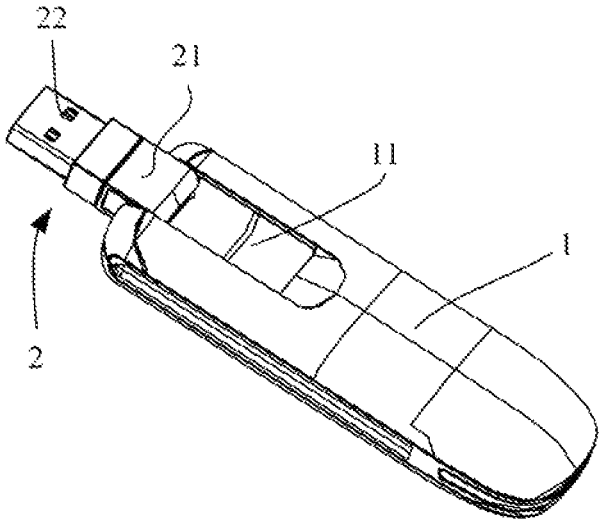
FIG. 2 illustrates a structural diagram of a data product with a USB interface in the first usage state in accordance with an embodiment of the present invention.
Figure 3:
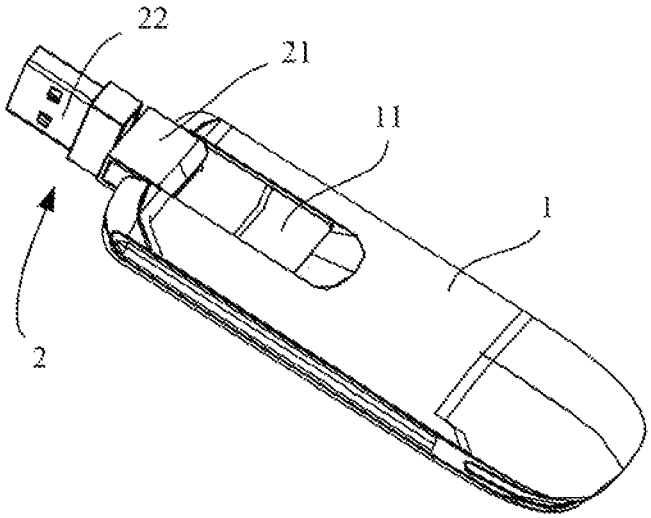
FIG. 3 illustrates a structural diagram of a data product with a USB interface in the second usage state in accordance with an embodiment of the present invention.
Figure 4:
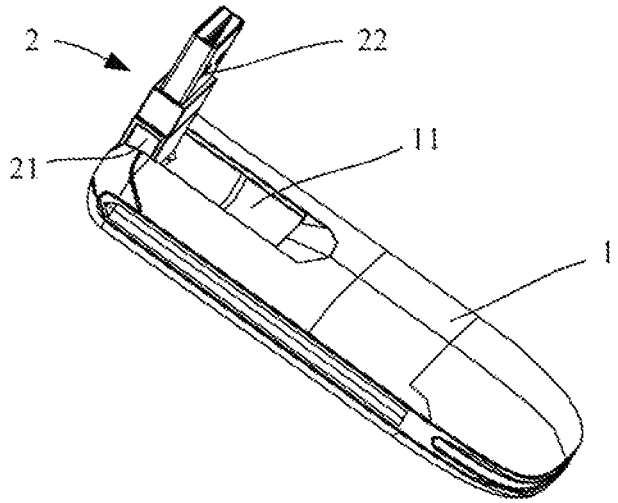
FIG. 4 illustrates a structural diagram of a data product with a USB interface in the third usage state in accordance with an embodiment of the present invention.
Figure 5:
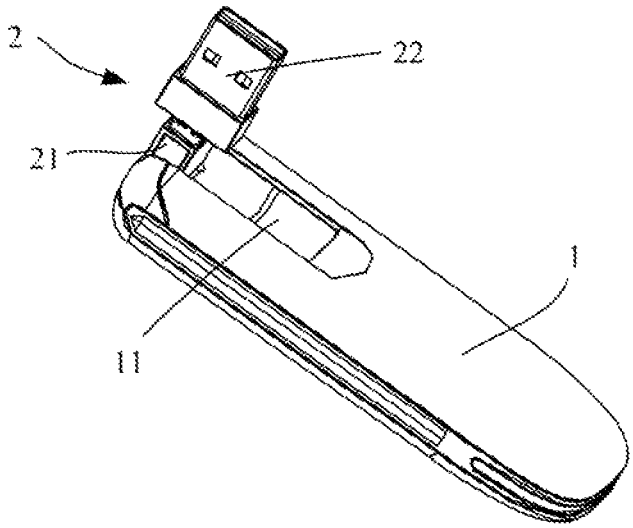
FIG. 5 illustrates a structural diagram of a data product with a USB interface in the fourth usage state in accordance with an embodiment of the present invention.
Figure 6:
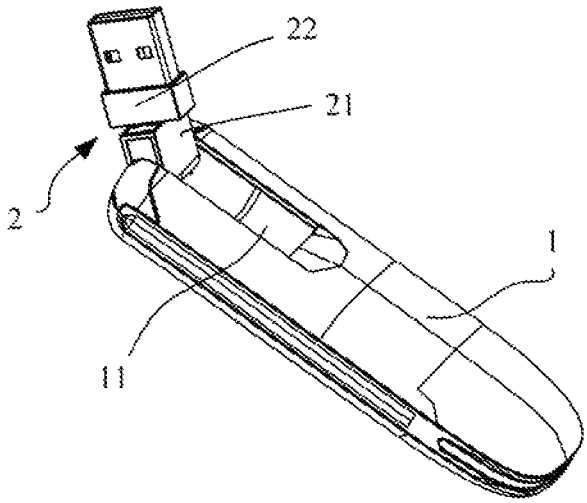
FIG. 6 illustrates a structural diagram of a data product with a USB interface in the fifth usage state in accordance with an embodiment of the present invention.
Figure 7:
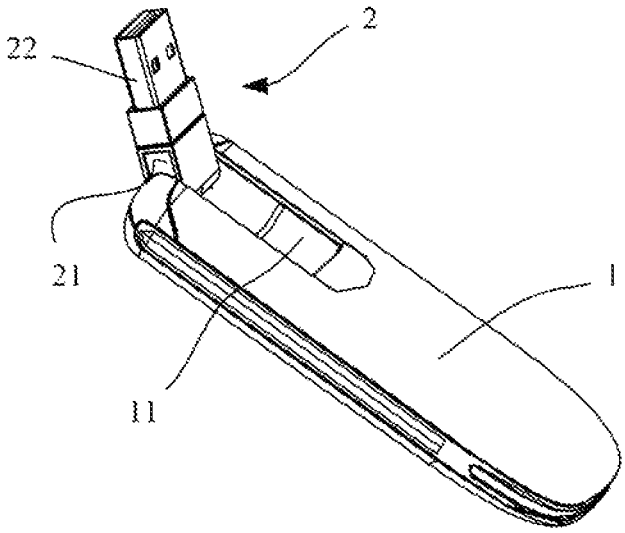
FIG. 7 illustrates a structural diagram of a data product with a USB interface in the sixth usage state in accordance with an embodiment of the present invention.
Figure 8:
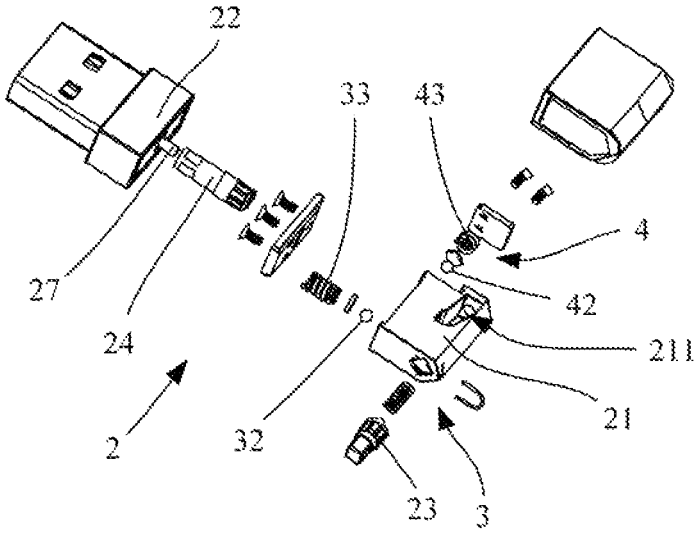
FIG. 8 illustrates an exploded view of a USB interface in accordance with an embodiment of the present invention.
Figure 9:
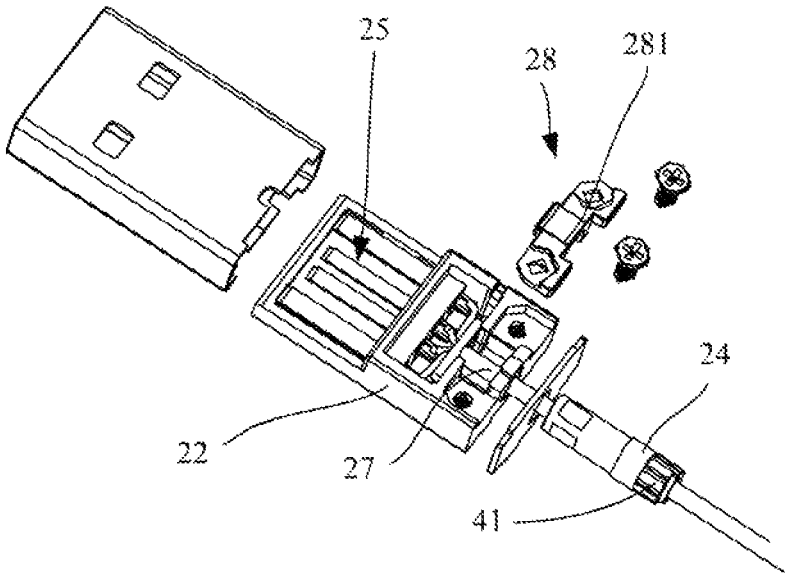
FIG. 9 illustrates the first exploded view of a rotating joint in a USB interface in accordance with an embodiment of the present invention.
Figure 10:
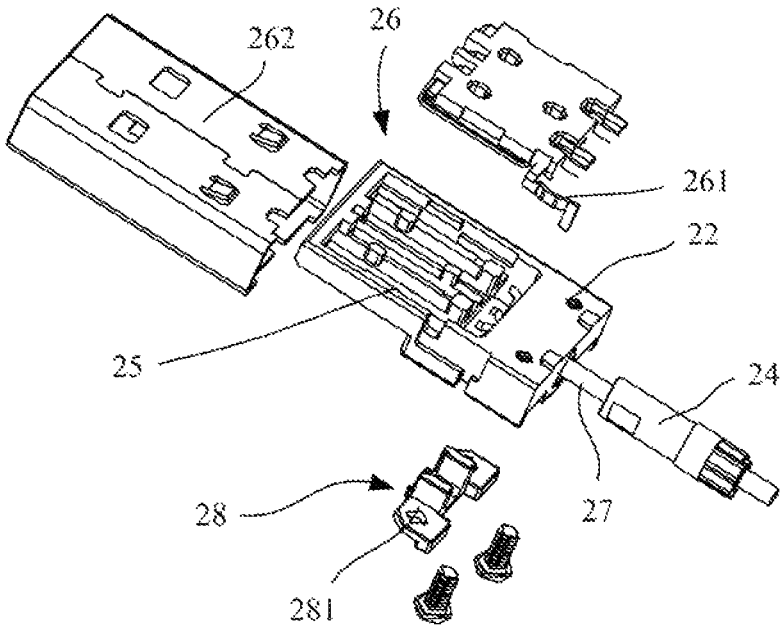
FIG. 10 illustrates the second exploded view of a rotating joint in a USB interface in accordance with an embodiment of the present invention.

As shown in FIGS. 8-10, the present invention provides a USB interface which comprises a turnover joint 21 and a rotating joint 22.

One end of the turnover joint 21 is connected to a data product body 1, and the other end is connected to the rotating joint 22 via a connecting shaft 22. The turnover joint 21 can be turned over relative to the data product body 1.

The end of the rotating joint 22 that is away from the turnover joint 21 is provided with a connecting terminal 25, on which a ground structure 26 is provided. The ground structure 26 comprises a ground resilient leg 261 connected to the connecting terminal 25 and connected to a metal shell of the ground structure 26 of the rotating joint 22, and a connecting shaft 24 and the turnover joint 21 are also made of metal material such that an outer structure of the interface in accordance with the present invention can be grounded effectively to form shielding to electromagnetic interference brought by a cable 27 passing through therein.

The connecting terminal 25 is connected to the data product body 1 via the cable 27, which passes through the connecting shaft 24 and a hole 211 in the turnover joint 21. The cable 27 is positioned in the connecting shaft 24 which is concentric with the hole 211 and the hole 211 is concentric with a turnover shaft 23 such that the rotation and turnover of the connecting shaft 24 and the turnover shaft 23 have minimal effect on the cable 27. The connecting terminal 25 is provided with a securing structure 28 at a position close to the connecting shaft 24. A tablet 281 is pressed against the connecting shaft 24 to secure the connecting shaft 24 to the connecting terminal 25.

The connecting shaft 24 is fixedly connected to the rotating joint 22, and rotatively connected to the turnover joint 21. As the connecting shaft 24 rotates, both the connecting terminal 25 and the connecting shaft 24 rotate the table 27 so as to reduce a pulling force exerted by the cable 27 on a bonding pad in the connecting terminal 58 to improve the stability and reliability of communication and increase lifetime of the USB interface in accordance with the present invention.

In the present invention, the turnover joint 21 and the rotating joint 22 are used such that when a data product is plugged into an electronic product, a variety of different position relationships may be generated with respect to the electronic product. These position relationships are very flexible and may be selected according to different practical requirements. In addition, in the present invention, the ground structure 26 is provided on the connecting terminal 25 and is fixed, and a movable connection between the connecting shaft 24 and the turnover joint 21 may be used to effectively improve the reliability and stability of communication.

Figure 12:
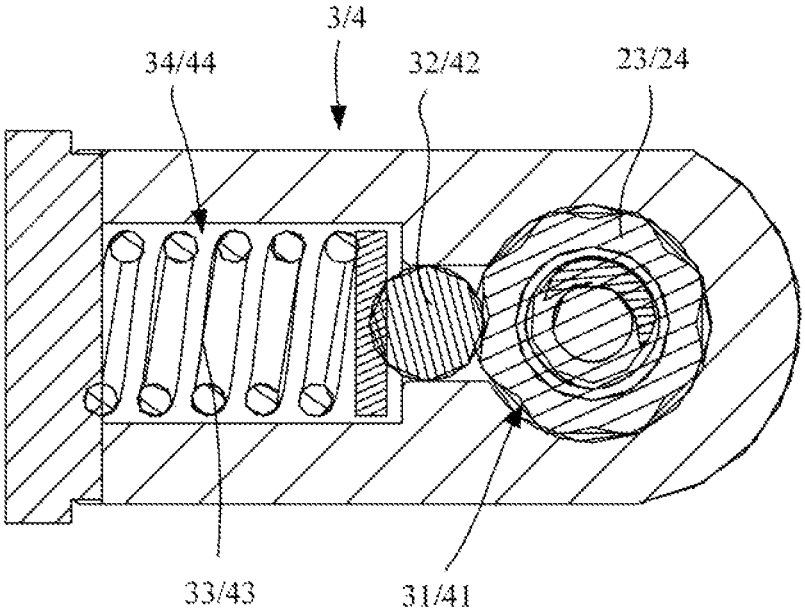
FIG. 12 illustrates a schematic diagram of a turnover-in-place structure and rotating-in-place structure in a USB interface in accordance with an embodiment of the present invention.

In the present invention, a turnover-in-place structure 3, which comprises turnover grooves 31, a turnover-in-place ball 32 and a turnover-in-place spring 33 as shown in FIG. 12, is positioned in the turnover joint 21.

A total of 8 turnover grooves 31 are evenly provided on the surface of the connecting shaft 23 to guarantee that a turnover angle terminates at 45°. Internal surfaces of the turnover grooves 31 are smooth, and depths of the grooves should be determined based on the size of the turnover-in-place ball 32. For the sake of convenience, the grooves may be processed as through grooves.

The turnover-in-place ball 32, the shape of which matches those of the turnover grooves 31, is provided in a turnover-in-place pore canal 34 connected to the turnover shaft 23. Both ends of the turnover-in-place ball 32 abut against the turnover-in-place grooves 31 and the turnover-in-place spring 33. The turnover-in-place ball 32 can be placed partially in the turnover grooves 31. During turnover, the turnover-in-place ball 32 can rotate with the turnover-in-place pore canal 34 relative to the turnover grooves 31.

The turnover-in-place spring 33 is positioned in the turnover-in-place pore canal 34. One end of the turnover-in-place spring 33 is fixed, and the other end pushes the turnover-in-place ball 32 through a connector. The turnover-in-place spring 33 exerts a reset force on the turnover-in-place ball 32, so as to achieve the turnover-in-place termination function.

Figure 11:
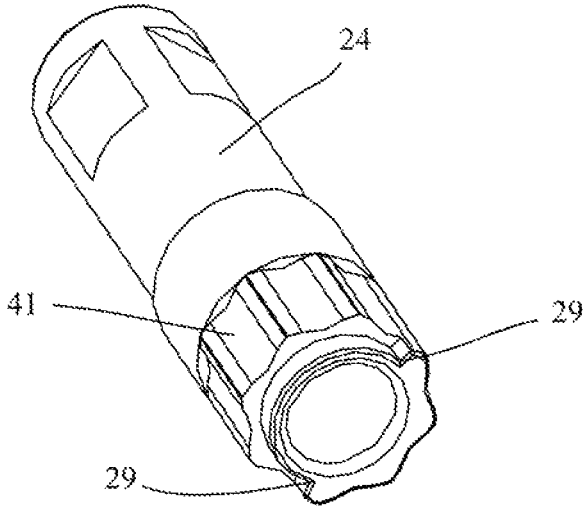
FIG. 11 illustrates a schematic diagram of a connecting shaft and a rotating-in-place structure in a USB interface in accordance with an embodiment of the present invention.

In the present invention, a rotating-in-place structure 4, which is the same as the turnover-in-place structure 3, as shown in FIG. 12, is positioned between the connecting shaft 24 and the turnover joint 21. The connecting shaft 24 and the rotating-in-place structure 4 are shown in FIG. 11. The rotating-in-place structure 4 comprises rotating grooves 41, a rotating-in-place ball 42 and a rotating-in-place spring 43.

A total of 8 rotating grooves 41 are evenly provided on the surface of the rotating joint 24 to guarantee that a rotating angle terminates at 45°. Internal surfaces of the rotating grooves 41 are smooth, and depths of the grooves should be determined based on the size of the rotating-in-place ball 42. For the sake of convenience, the grooves may be processed as through grooves.

The rotating-in-place ball 42, the shape of which matches those of the rotating grooves 41, is provided in a rotating-in-place pore canal 44 connected to the rotating joint 24. Both ends of the rotating-in-place ball 42 abut against the rotating-in-place grooves 41 and the rotating-in-place spring 43. The rotating-in-place ball 42 can be placed partially in the rotating grooves 41. During rotation, the rotating-in-place ball 42 can rotate with the rotating-in-place pore canal 44 relative to the rotating grooves 41.

The rotating-in-place spring 43 is positioned in the rotating-in-place pore canal 44. One end of the rotating-in-place spring 43 is fixed, and the other end pushes the rotating-in-place ball 42 through a connector. The rotating-in-place spring 43 exerts a reset force on the rotating-in-place ball 42, so as to achieve the rotating-in-place termination function.

The in-place structure, whether the turnover-in-place structure 3 or the rotating-in-place 4, can generate a pause when turning over or rotating in accordance with the present invention such that users can have obvious hand feeling. In addition, it is more important that since the turnover-in-place ball 32 and the rotating-in-place ball 42 are used and the original sliding friction is replaced with rolling friction during the turnover and rotation, wear is decreased largely and service time is increased effectively.

In the present invention, a position limiting structure 29 for limiting a rotating angle of the rotating joint 22 relative to the turnover joint 21 is positioned between the connecting shaft 24 and the turnover joint 21. The maximum rotating angle limited by the position limiting structure 29 is 90° to avoid too large left and right rotation while achieving rotation of one cycle. As shown in FIG. 11, this position limiting structure 29 can be implemented by providing a position limiting platform on the connecting shaft 24. When the connecting shaft 24 rotates relative to the turnover joint 21, the position limiting platform can limit the rotation angle.

In the present invention, the position limiting structure 29 is positioned between the connecting shaft 24 and the turnover joint 21 so as to effectively limit the rotating angle of the rotating joint 22 relative to the turnover joint 21, and avoid winding and breaking of a communication cable 27 due to over-rotation of the rotating joint, causing unnecessary losses.

As shown in FIGS. 1-7, the present invention also provides a data product with a USB interface comprising a data product body 1 and a USB interface 2.

A trough 11 matching the USB interface 2 is provided in a corresponding position in the data product body 1 to rotate and retract the USB interface 2 into the trough 11 conveniently in a retraction state such that the data product is beautiful and portable and the USB interface 2 can be protected.

The rotating joint 22 can rotate relative to the turnover joint 21 such that users can conveniently select a plug-in angle of the data product; and the turnover joint 21 can turn over relative to the data product body 1 such that the users can conveniently adjust the angle of the data product.

The structure of the USB interface 2 is shown above and will not be repeated here. Various state structures of the data product in accordance with the present invention illustrated in FIGS. 1-7 show the flexible use and the extremely strong adaptive capability of the data product in accordance with the present invention and can be used in all kinds of narrow spaces. Moreover, these different usage states can improve the beauty of the data product in accordance with the present invention and the interest of the users.

In the present invention, the cable 17 comprises four coaxial cables coated with a shielding material. This structure can be used to further improve shielding capability.

In summary, the above description is only the embodiments of the present invention and is not intended to limit the present invention. Various modifications, equivalent substitutions and improvements made within the spirit and principle of the present invention should be covered in the scope of the appended claims of the present invention.

INDUSTRIAL APPLICABILITY

In the present invention, a turnover joint and a rotating joint are used such that when a data product is plugged into an electronic product, a variety of different position relationships may be generated with respect to the electronic product. The position relationships are very flexible and may be selected according to different practical requirements. In the present invention, a ground structure is provided on a connecting terminal and is fixed, and a movable connection between a connecting shaft and the turnover joint may be used to effectively improve the reliability and stability of communication. In the present invention, in-place structures are used within the turnover joint as well as between the connecting shaft and the turnover joint so as to facilitate rotating-in-place and turnover-in-place in the data product in accordance with the present invention, extend the usage function, and increase the stability of in-place in use. In the present invention, a position limiting structure is positioned between the connecting shaft and the turnover joint so as to effectively limit a rotating angle of the rotating joint relative to the turnover joint, and avoid winding and breaking of a communication cable due to over-rotation of the rotating joint, causing unnecessary losses.

What is claimed is:

1. A universal serial bus (USB) interface comprising a turnover joint (21), a rotating joint (22) and a connecting shaft (24) connecting the turnover joint (21) with the rotating joint (22); wherein one end of the turnover joint (21) is connected to a data product body (1), and the other end is connected to the rotating joint (22); and the end of the rotating joint (22) that is away from the turnover joint (21) is provided with a connecting terminal (25), which is connected to the data product body (1) via a cable (27); the rotating joint (22) is rotatable relative to the turnover joint (21);

wherein the turnover joint (21) is connected to the data product body (1) via a turnover shaft (23), which is fixedly connected to the rotating joint (22) and rotatably connected to the turnover joint (21); and wherein a turnover-in-place structure (3) is positioned in the turnover joint (21) and comprises:

turnover grooves (31) provided on a surface of the turnover shaft (23);

a turnover-in-place ball (32), the shape of which matches those of the turnover grooves (31), provided in a turnover-in-place pore canal (34) connected to the turnover shaft (23), both ends of the turnover-in-place ball (32) abutting against the turnover-in-place grooves (31) and a turnover-in-place spring (33); and the turnover-in-place spring (33) positioned in the turnover-in-place pore canal (34), one end of the turnover-in-place spring (33) being fixed, and the other end pushing the turnover-in-place ball (32) through a connector.

2. The USB interface according to claim 1, wherein a ground structure (26) is provided on the connecting terminal (25), and the ground structure (26) comprises a ground resilient leg (261) that connects the metal outer shell (262) of the USB interface with a ground wire of the cable (27).

3. The USB interface according to claim 1, wherein the cable (27) is connected to the turnover joint (21) through the connecting shaft (24) and is provided with a securing structure (28), used for securing the cable (27), on a position close to the connecting terminal (25).

4. The USB interface according to claim 1, wherein a rotating-in-place structure (4) is positioned between the connecting shaft (24) and the turnover joint (21) and comprises:

rotating grooves (41) provided on a surface of the rotating shaft (24);

a rotating-in-place ball (42), the shape of which matches those of the rotating grooves (41), provided in a rotating-in-place pore canal (44) connected to the connecting shaft (24), both ends of the rotating-in-place ball (42) abutting against the rotating-in-place grooves (41) and a rotating-in-place spring (43); and the rotating-in-place spring (43) positioned in the rotating-in-place pore canal (44), one end of the turnover-in-place spring (43) being fixed, and the other end pushing the turnover-in-place ball (32) through a connector.

5. The USB interface according to claim 1, wherein a position limiting structure (29) for limiting a rotation angle of the rotating joint (22) relative to the turnover joint (21) is positioned between the connecting shaft (24) and the turnover joint (21).

6. A data product with a universal serial bus (USB) interface comprising a data product body (1) and a USB interface (2); wherein the USB interface (2) comprises a turnover joint (21), a rotating joint (22), a connecting shaft (24) connecting the turnover joint (21) with the rotating joint (22), and a turnover shaft (23) connecting the data product body (1) with the turnover joint (21);

a trough (11) matching the USB interface (2) is provided in a corresponding position in the data product body (1);

the end of the rotating joint (22) that is away from the turnover joint (21) is provided with a connecting terminal (25), which is connected to the data product body (1) via a cable (27); and the rotating joint (22) is rotatable relative to the turnover joint (21), which is rotatable relative to the data product body (1);

wherein a turnover-in-place structure (3) is positioned in the turnover joint (21) and comprises:

turnover grooves (31) provided on a surface of the turnover shaft (23);

a turnover-in-place ball (32), the shape of which matches those of the turnover grooves (31), provided in a turnover-in-place pore canal (34) connected to the turnover shaft (23), both ends of the turnover-in-place ball (32) abutting against the turnover-in-place grooves (31) and a turnover-in-place spring (33); and the turnover-in-place spring (33) positioned in the turnover-in-place pore canal (34), one end of the turnover-in-place spring (33) being fixed, and the other end pushing the turnover-in-place ball (32) through a connector.

7. The data product according to claim 6, wherein the connecting shaft (24) is fixedly connected to the rotating joint (22) and rotatably connected to the turnover joint (21).

8. The data product according to claim 6, wherein a ground structure (26) is provided on the connecting terminal (25), and the ground structure (26) comprises a ground resilient leg (261) that connects the metal outer shell (262) of the USB interface with a ground wire of the cable (27).

9. The data product according to claim 6, wherein the cable (27) is connected to the turnover joint (21) through the connecting shaft (24) and is provided with a securing structure (28), used for securing the cable (27), on a position close to the connecting terminal (25).

10. The data product according to claim 6, wherein a rotating-in-place structure (4) is positioned between the connecting shaft (24) and the turnover joint (21) and comprises:

rotating grooves (41) provided on a surface of the rotating shaft (24);

a rotating-in-place ball (42), the shape of which matches those of the rotating grooves (41), provided in a rotating-in-place pore canal (44) connected to the connecting shaft (24), both ends of the rotating-in-place ball (42) abutting against the rotating-in-place grooves (41) and a rotating-in-place spring (43); and the rotating-in-place spring (43) positioned in the rotating-in-place pore canal (44), one end of the rotating-in-place spring (43) being fixed, and the other end pushing the rotating-in-place ball (42) through a connector.

11. The data product according to claim 6, wherein a position limiting structure (29) for limiting a rotation angle of the rotating joint (22) relative to the turnover joint (21) is positioned between the connecting shaft (24) and the turnover joint (21).

12. The data product according to claim 6, wherein the cable (27) comprises four coaxial cables coated with a shielding material.

* * * * *